US007753012B2

(12) United States Patent
Neese

(10) Patent No.: US 7,753,012 B2
(45) Date of Patent: Jul. 13, 2010

(54) MOTORCYCLE COMPRISING A COMPACT INTERNAL COMBUSTION ENGINE

(76) Inventor: Clemens Neese, Kemnatenstrasse 66, 80639 München (DE)

( * ) Notice: Subject to any disclaimer, the term of this patent is extended or adjusted under 35 U.S.C. 154(b) by 346 days.

(21) Appl. No.: 11/661,586

(22) PCT Filed: Sep. 1, 2005

(86) PCT No.: PCT/DE2005/001534

§ 371 (c)(1),
(2), (4) Date: Feb. 27, 2007

(87) PCT Pub. No.: WO2006/026960

PCT Pub. Date: Mar. 16, 2006

(65) Prior Publication Data

US 2008/0168957 A1 Jul. 17, 2008

(30) Foreign Application Priority Data

Sep. 5, 2004 (DE) ..... 10 2004 042 765

(51) Int. Cl.
*F02B 75/22* (2006.01)
*F01L 1/02* (2006.01)

(52) U.S. Cl. ..... 123/54.4; 123/90.27

(58) Field of Classification Search ..... 123/54.4–54.8, 123/90.27

See application file for complete search history.

(56) References Cited

U.S. PATENT DOCUMENTS

| | | | | |
|---|---|---|---|---|
| 1,531,430 | A * | 3/1925 | Wrentmore | 123/54.7 |
| 2,944,536 | A * | 7/1960 | Payne | 123/54.4 |
| 4,194,469 | A * | 3/1980 | Kruger | 123/54.6 |
| 4,319,548 | A * | 3/1982 | Kruger | 123/54.4 |
| 6,076,489 | A | 6/2000 | Deutsch et al. | |
| 6,257,178 | B1 | 7/2001 | Laimbock | |
| 6,745,730 | B2 * | 6/2004 | Yamashita | 123/54.5 |

FOREIGN PATENT DOCUMENTS

| | | |
|---|---|---|
| DE | 29 04 066 | 8/1980 |
| DE | 198 00 037 | 7/1999 |
| EP | 1 146 219 | 10/2001 |
| EP | 1 228 956 | 8/2002 |

OTHER PUBLICATIONS

"Ulti-MUMM" by Yamada; *Motorrad* 24/1979; pp. 30-34.

* cited by examiner

*Primary Examiner*—Noah Kamen
(74) *Attorney, Agent, or Firm*—Blakely, Sokoloff, Taylor & Zafman

(57) ABSTRACT

The invention relates to a motorcycle comprising a space-saving, lightweight motor assembly. The use of a compact W or VR-type internal combustion engine permits the motorcycle to have reduced dimensions and a low weight. Internal combustion engines comprising six to twelve cylinders can thus be used for motorcycles. The compact dimensions of the motor enable the production of motorcycles with sleek lines and an advantageous aerodynamic shape.

12 Claims, 11 Drawing Sheets

MOTORCYCLE COMPRISING A COMPACT INTERNAL COMBUSTION ENGINE

Figure 1:
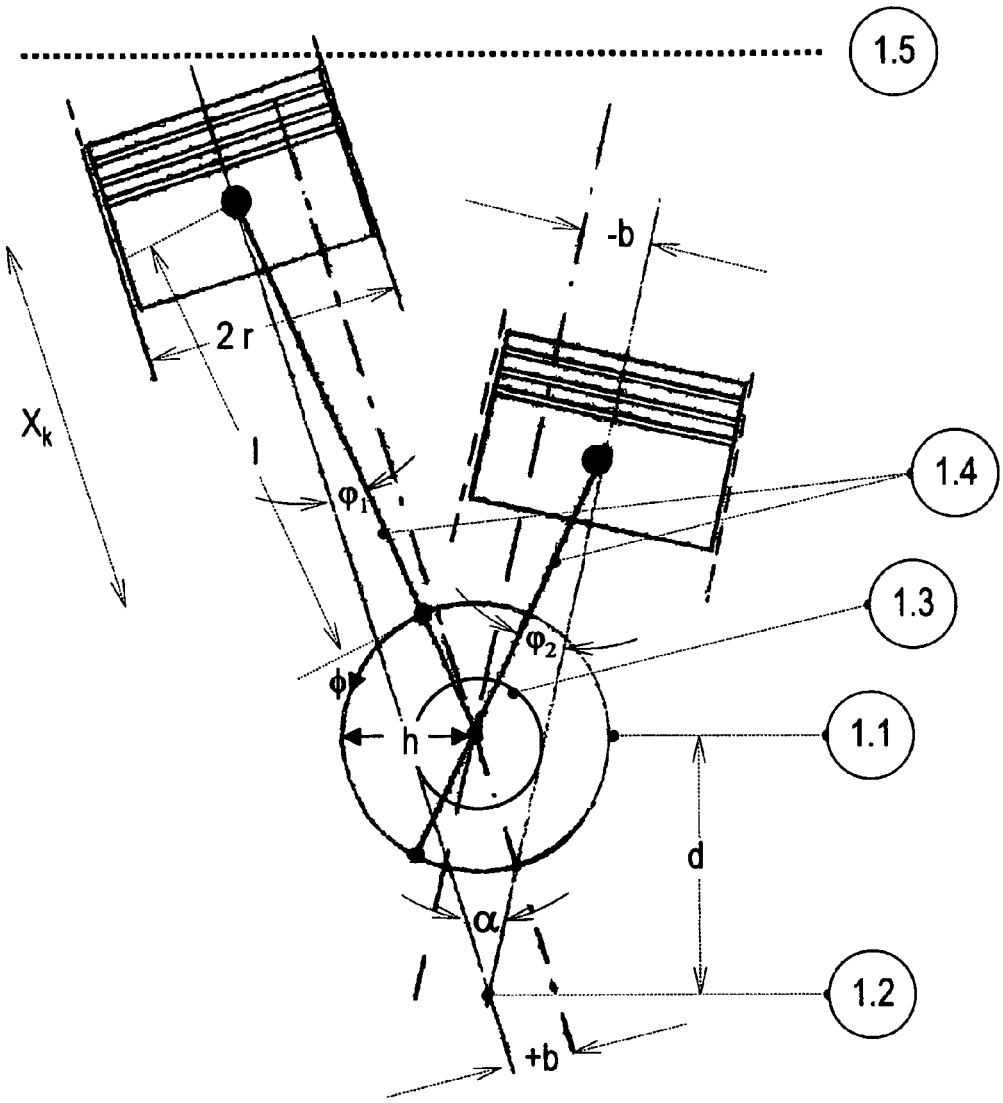

This is a non-provisional application claiming the benefit of International application number PCT/DE2005/001534 filed Sep. 1, 2005.

FIELD

The invention relates to a motor cycle with a motor arrangement, which saves space and weight, in accordance with the claims. In particular, a compact internal combustion engine on the V-inline and W principle is used, which is distinguished by very small dimensions and a low weight in relation to the swept volume and/or number of cylinders.

BACKGROUND

Motor cycles primarily have internal combustion engines for their propulsion. Air- or liquid-cooled Otto motors are commonly used, which operate on the two-stroke or four-stroke principle. Diesel motors or Wankel engines are also known. As regards the cylinder arrangement, boxer, in-line or V arrangements with a transversely extending or longitudinal extending crankshaft are used. Single cylinder motors and, with a multi-cylinder arrangement, two to six cylinder motors are known. No motors with a larger number of cylinders have previously been built in mass production due to a lack of space and even six cylinders have up to now appeared only in isolated cases due to their structural size.

In accordance with current technology, motor cycles are provided with motor installations, which can be divided into two basic geometries: In the first case, the crankshaft extends longitudinally with respect to the direction of movement and thus enables the transmission of force via the gearbox to the rear wheel axle via a longitudinally extending driveline (cardan shaft transmission). Only one change in direction of the shaft (90 degrees) directly at the rear wheel is necessary in order to drive the rear wheel and thus a relatively easy and low-maintenance drive, which has low losses, is ensured. In the second case, the crankshaft extends transversely to the direction of movement. This means the transmission of force to the rear wheel with transversely extending shafts, and generally a chain transmission between the gearbox output shaft and the rear wheel. This type of construction achieves the highest degree of efficiency in power transmission and renders a low weight and low manufacturing costs possible but is more maintenance intensive. Constructions in which manufacturing costs are low are, however, more maintenance intensive. Constructions in which power transmission is effected exclusively with shafts without using a chain transmission to the rear wheel with the crankshaft extending transversely to the direction of movement require two changes in direction of the shaft in the shaft transmission sequence, firstly a change of direction (90 degrees) at the gearbox output from transverse to longitudinal (with respect to the direction of movement) to cover the distance to the rear wheel and there again from the longitudinal direction to transverse (90 degrees) to transmit the drive moment to the rear axle. This has a lower efficiency of the drive as a consequence, requires more weight and space and is more expensive to manufacture. This construction is, however, also used due to the greater freedom from maintenance by comparison with chain drives. Examples of chain drives with a longitudinally extending crank shaft are not known in mass production.

With longitudinally extending crankshafts and a multi-cylinder motor construction, it is disadvantageous that conventional arrangements result either in an excessive structural breadth (boxer motors, traditional V motors) or an excessive structural length (e.g. mounting a multi-cylinder inline motor in the longitudinal direction). Furthermore, there are multiple cylinder heads with boxer or V motors. Constructions of this type have been known since the 1920's as also have the associated problems of dimensions and weight.

Transversely extending crankshafts are not convenient for implementing a light, simple and effective cardan transmission. They result, however, when using a chain transmission to the rear wheel, in a favourable weight and the best efficiency in the driveline. Of disadvantage when transversely mounting inline motors is the wide frontal area, which, with an increasing number of cylinders, is at odds with the desired streamline shape and the manoeuvrability of a motor cycle as a result of large lateral distances from the centre of gravity of the vehicle. For this reason e.g. models with transversely extending, six-cylinder inline motors of 750 to 1300 cc capacity from the 1980's from different manufacturers have disappeared from the market without any great success. The maximum common number of cylinders nowadays with transversely extending inline motors for motor cycles is four.

With existing constructions of motor cycle V motors with a transversely extending crankshaft and a large V angle, the structural length in the direction of movement and the necessity of multiple cylinder heads proves to be a disadvantage. Mass produced models of this type are known with two to five cylinders.

Motor cycles have no body work in the manner of a motor car, the motor of which is surrounded over a large area by it. In distinction to a motor car, the outer shape and size of a motor cycle motor influences the aerodynamics and manoeuvrability of a motor cycle very directly as a crucial component of its external shape. Improvements in the field of motor dimensions and weights for motor cycles are therefore of major significance.

SUMMARY

It is therefore the object of the invention to provide a motor cycle with a more compact, multi-cylinder motor.

The result of a V-inline arrangement or W arrangement of the cylinders is a particularly compact structure of the motor. Regardless of whether it is in the form of e.g. a three cylinder motor or a twelve cylinder, significantly more compact dimensions are produced than with known motor cycle engine concepts.

This enables larger numbers of cylinders and/or swept volumes with smaller structural dimensions and weights and better aerodynamics and manoeuvrability with longitudinal or transverse crankshafts (with respect to the direction of movement).

In particular, a V-inline arrangement with a transverse crankshaft results in a very small end surface area of the cylinder arrangement (this applies also to transverse W arrangements). Of advantage is the aerodynamically favourable shape of the motor cycle engine, which additionally increases the ground clearance for oblique positions of the motor cycle on bends. Many cylinders may be provided without producing a wide, inharmonious end surface of the motor. The motor also becomes considerably lighter so that even multi-cylinder motors with swept volumes above 750-1000 cm can be used for motor cycles which are of powerful design as regards driving dynamics.

With a transverse V-inline 5 of V-inline 6 motor, such compact dimensions, for instance, are produced that the motor fits very snugly into the line of the motor cycle, despite its transverse mounting in distinction to the very widely known six cylinder inline engines.

In addition to the aspects referred to above, a significantly greater acceptance by customers is thus achieved. It is also possible that a V-inline 8 engine may be installed which also fits well into the line of a motor cycle transversely, with an adapted swept volume, and is not disruptive as a result of bulky dimensions.

A V-inline cylinder bank will be referred to below as the sum of two V-inline cylinder rows in a common cylinder housing. A V-inline motor thus consists of a cylinder bank with two cylinder rows arranged offset. The result of a V shaped coupling of two V-inline cylinder banks, all of which act on one crankshaft, is a W arrangement. A four, six, eight, ten or twelve cylinder engine can thus be built so compactly that it is suitable for mounting in a motor cycle. A W motor thus consists of the coupling of two V-inline cylinder banks with two respective rows of cylinders, that is to say four in all.

With a longitudinal crankshaft, multi-cylinder engines may be produced for motor cycles with typical or even larger swept volumes by way of a W arrangement (and also by way of a V-inline arrangement) whilst simultaneously achieving very compact longitudinal and breadth dimensions of the motor cycle. Moreover, the shape of a W or V-inline engine with a longitudinal crankshaft accommodates the ground clearance and enables relatively large inclined positions when driving round bends and a favourable cardanic drive with only one change in direction of the shaft.

In a preferred embodiment, the crank mechanism of the motor cycle engines is offset. In a V-inline motor cycle engine, the two planes, which are defined by the cylinder axis of each cylinder row, intersect beneath the crankshaft axis. Assuming a vertical central plane (which includes the crankshaft central axis), the two planes of the two V-inline cylinder banks (each with two cylinder rows) in a W motor intersect below the crankshaft axis and on the opposite side of the central plane.

In one embodiment, in V-inline and W motor cycle engines the V-inline cylinder banks with two cylinder rows are combined into one coherent cylinder block, which is covered by a cylinder head common to these two rows.

In one embodiment, V-inline and W motor cycle engines are used in a monobloc motor construction. The motor and gearbox thus constitute a space- and weight-saving unit by using a common housing and a common oil reservoir. This is common in motor cycle construction, particularly with transverse motors with transverse shafts up to the output of the gearbox and the space advantages, which are produced by the V-inline or W arrangement of the cylinders and by the monobloc motor construction, are combined in a favourable manner.

In one embodiment, a transverse V-inline motor cycle engines with an odd number of cylinders having, is described a forwardly tapered shape, in the direction of movement, of the cylinder block and cylinder head, which is favourable as regards air flow is provided. The number of the cylinders in the front row of cylinders is n and in the rear row of cylinders is n+1, where n is greater than or equal to 1.

The possibility has also proved to be favourable of constructing motor cycle engines on the V-inline and W principle in accordance with claims 20 and 21 with a selectively long stroke or short stroke design. Depending on the type of motor cycle, a more favourable forque transmission is achieved in the long stroke design and higher speeds and a higher peak power are achieved in the short stroke design.

DRAWINGS

Further advantages of the invention will be apparent from the following exemplary embodiments which will be explained in more detail with reference to drawings, which show as follows:

FIG. 1: The advantageous usage of an offset crank mechanism

Figure 2:
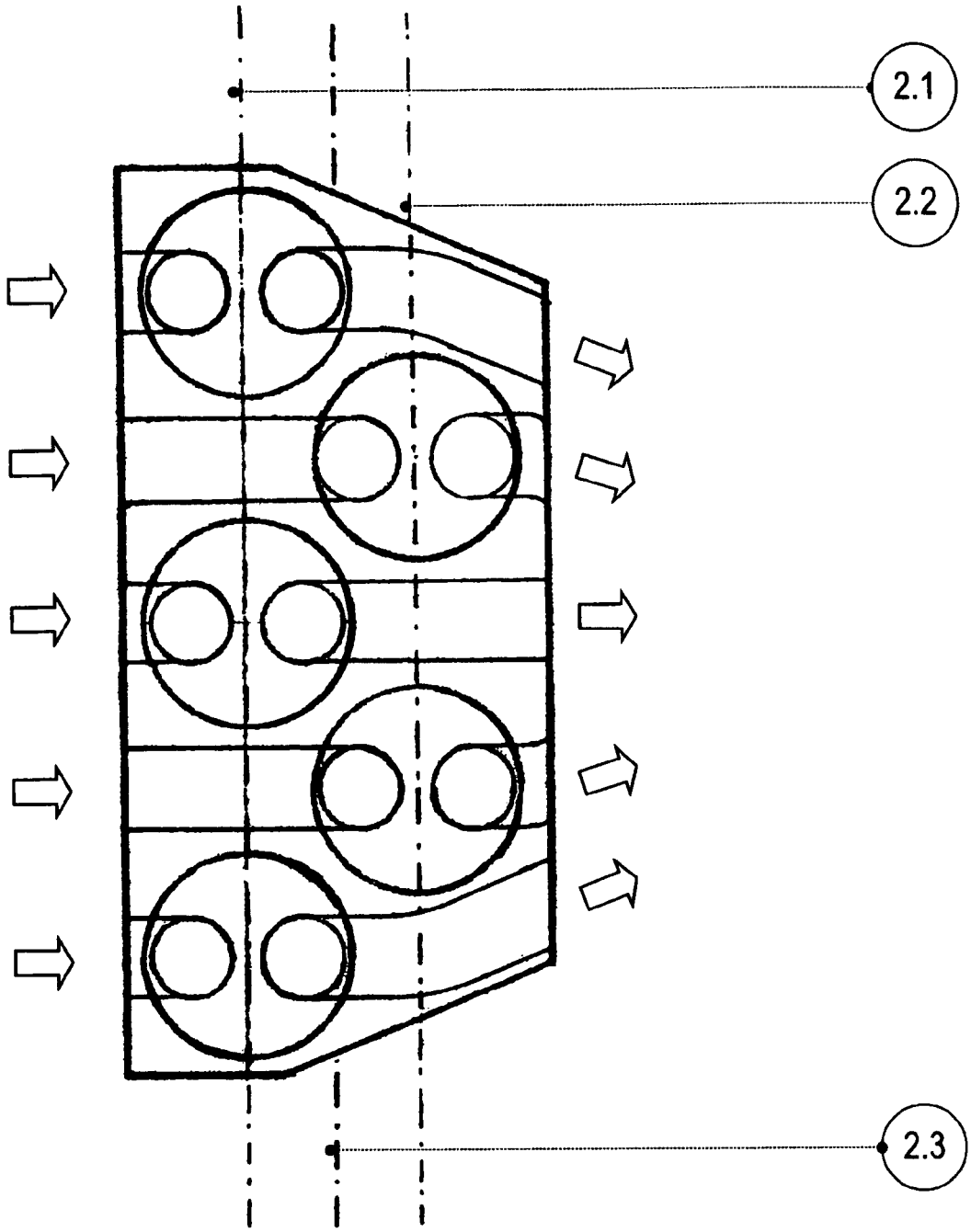
Figure 3:
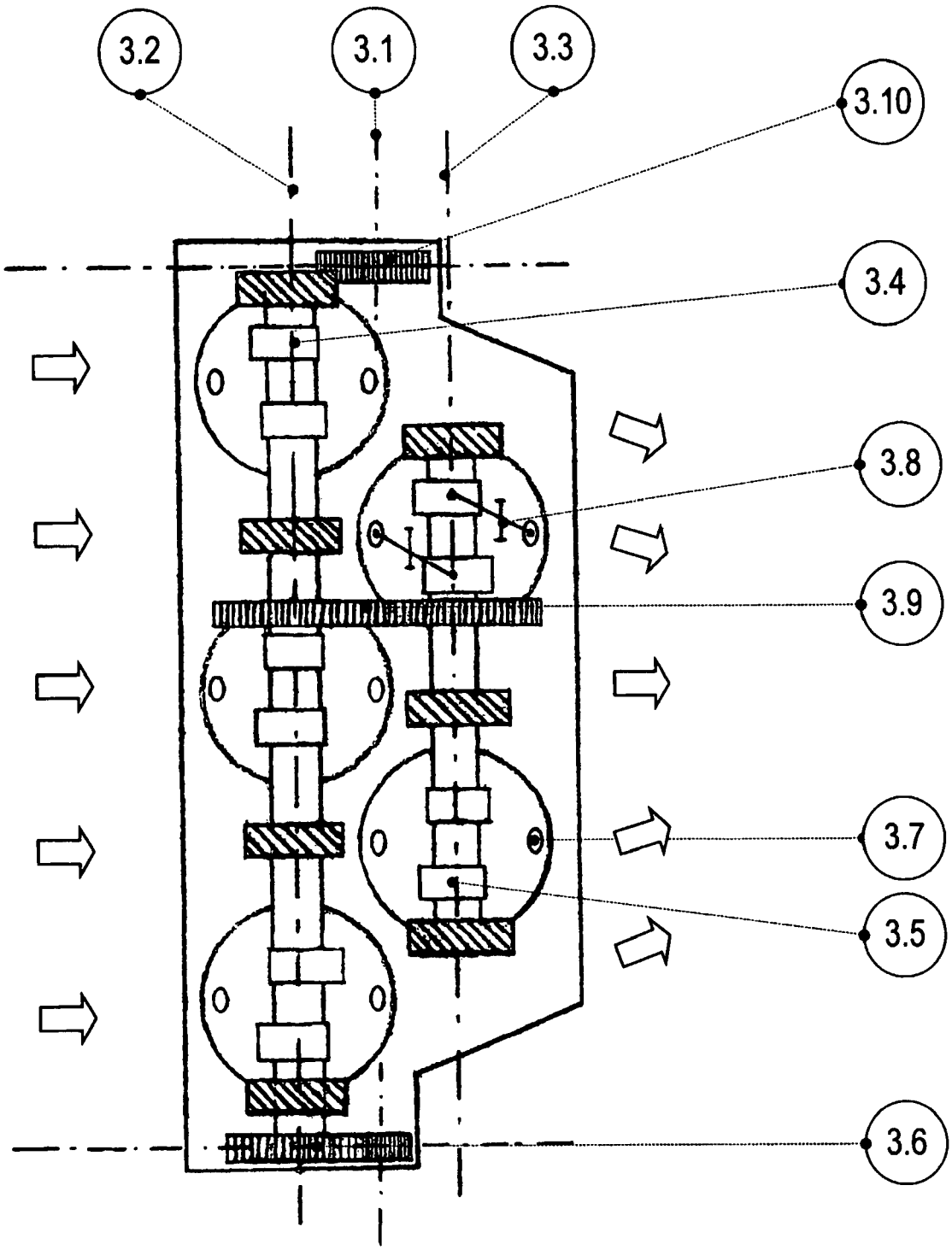

FIG. 2: A favourable cylinder head construction for V-inline motors with an uneven number of cylinders for mounting transversely in motor cycles, gas conduction, plan view FIG. 3: A favourable cylinder head construction for V-inline motors with an uneven number of cylinders for mounting transversely in motor cycles, camshaft drive, plan view FIG. 4: A space-saving cylinder head construction for high speeds in motor cycles FIG. 5: A schematic view of a space- and weight-saving V-inline motor cycle motor construction of monobloc type, view 1

Figure 6:
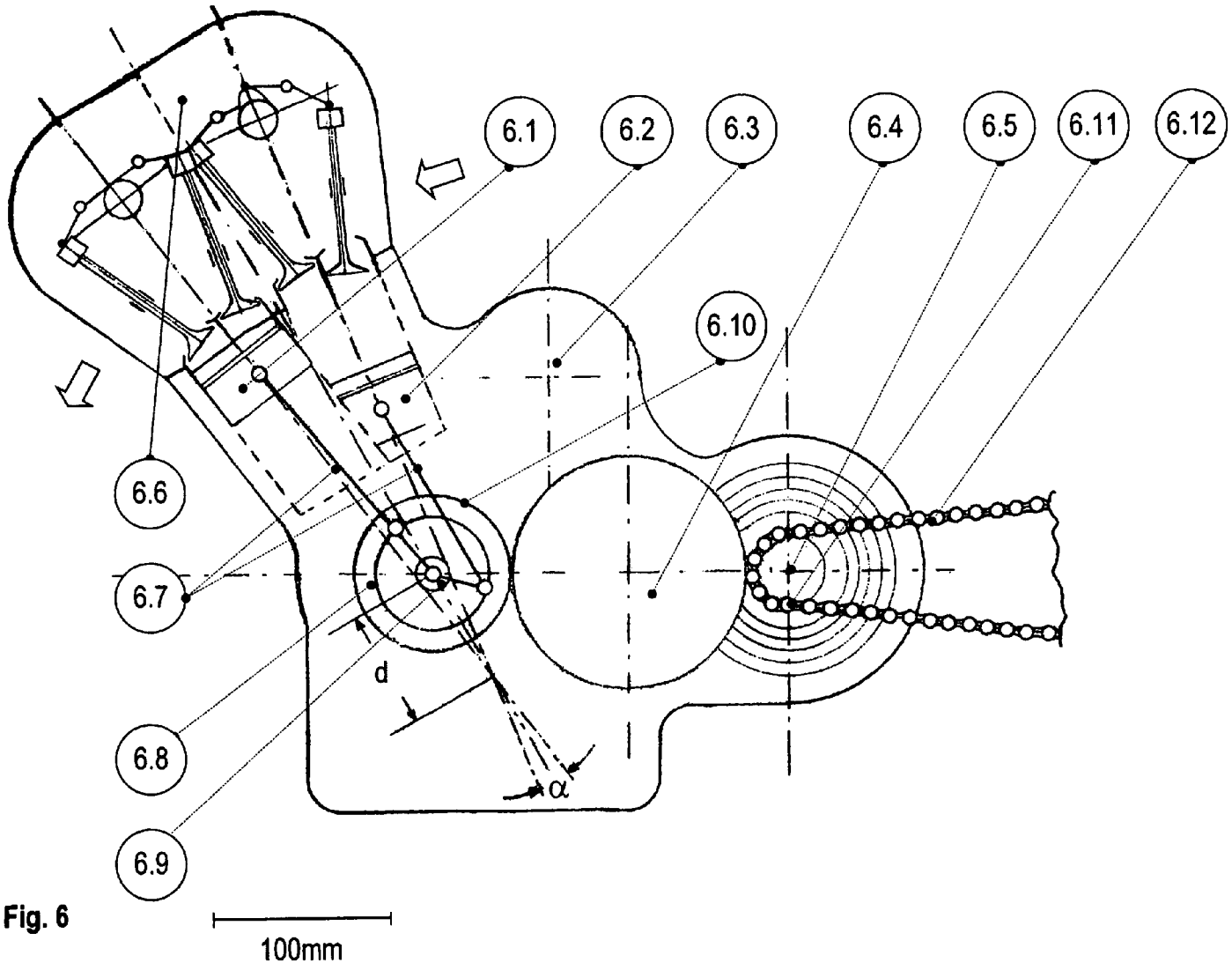

FIG. 6: A schematic view of a space- and weight-saving V-inline motor cycle motor construction of monobloc, view 2

Figure 7:
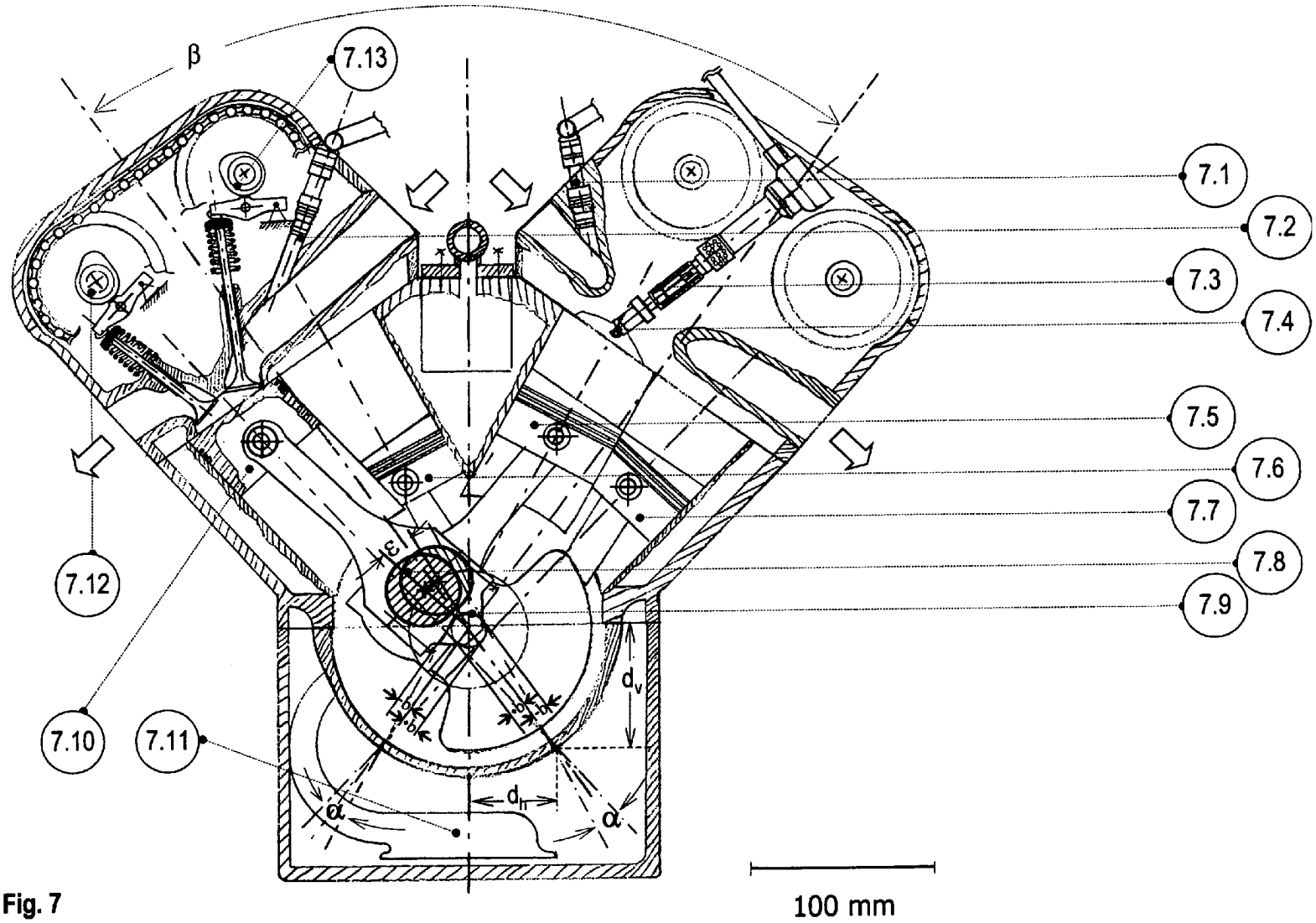

FIG. 7: A schematic view of a space- and weight-saving motor cycle motor construction of W type FIG. 8: An exemplary embodiment for a V-inline-6 motor cycle, view 1

Figure 9:
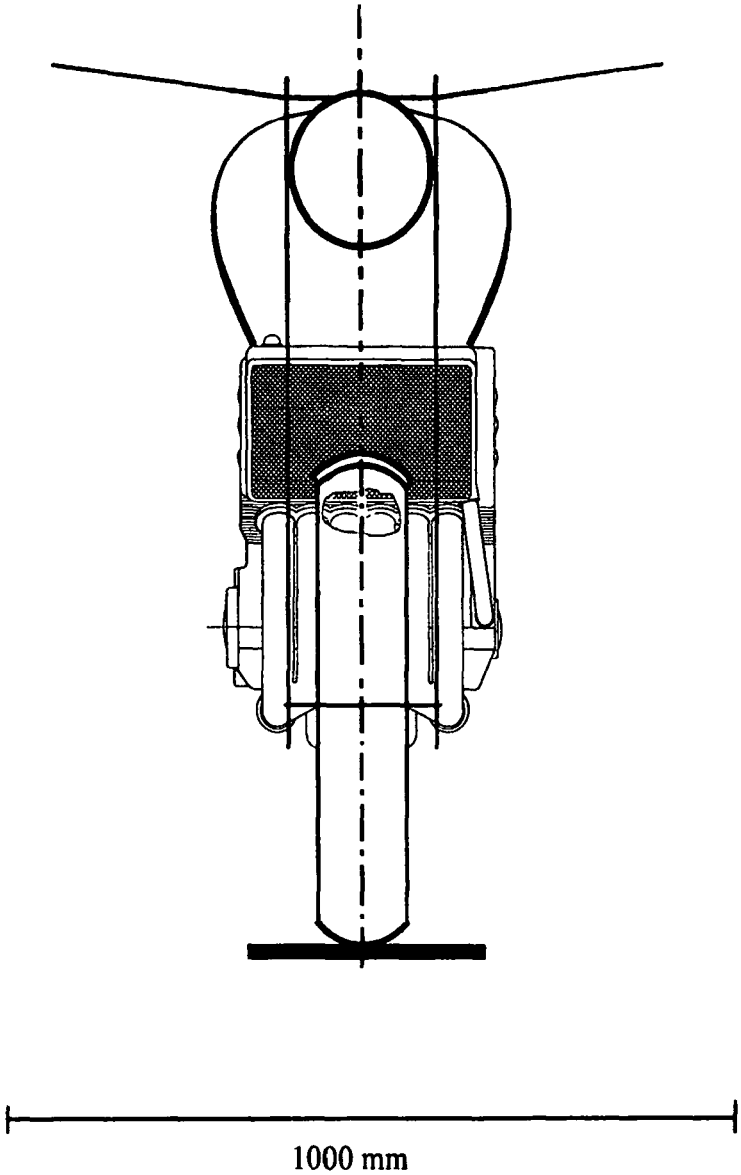

FIG. 9: An exemplary embodiment for a V-inline-6 motor cycle, view 2

Figure 10:
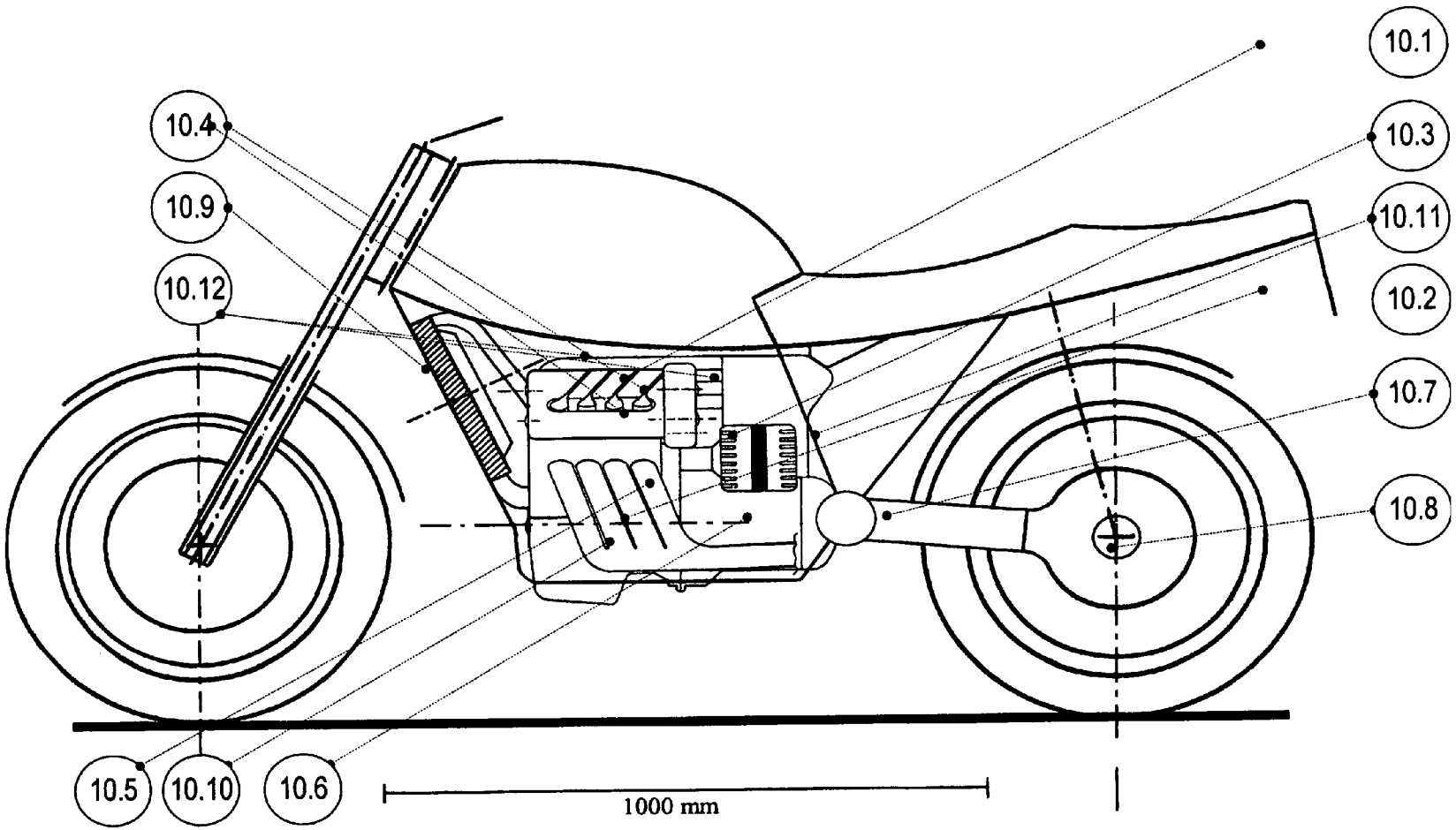

FIG. 10: An exemplary embodiment for a W-8 motor cycle, view 1

Figure 11:
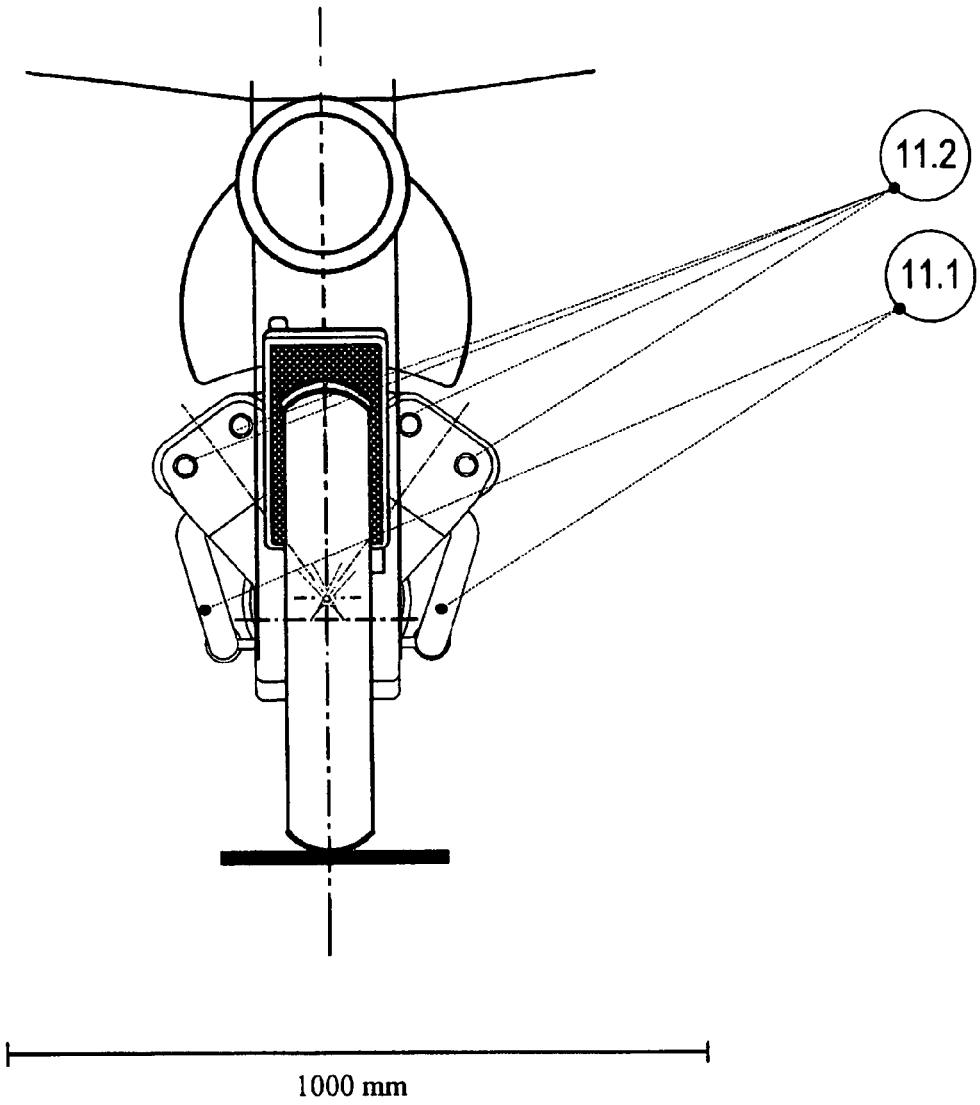

FIG. 11: An exemplary embodiment for a W-8 motor cycle, view 2

DETAILED DESCRIPTION

In conventional Otto motors, the crank mechanism is so designed that the central axis of the piston path intersects the rotary axis of the crankshaft and the rotary axis of the gudgeon pin, apart from the usual offsetting of the gudgeon pin to influence the reversal dynamics by means of the piston clearance. This results in a symmetrical crank geometry and dynamics between TDC and BDC, which occur at a crank angle $\phi$ of 0° and 180°, respectively. With a significantly offset crank mechanism, the central axis of the piston path is displaced with respect to the crank axis by the degree of offset +/−b (FIG. 1). The combination of two mirror-symmetrically offset crank mechanisms in a V motor configuration (FIG. 1) results in a height reduction of the motor dimensions by the amount d, which results from the distance between the hypothetical central axis of a non-offset crank circle 1.2 and the central axis of the crank circle 1.1, displaced by the offset, with the radius h and the crank angle $\phi$. This is advantageous, particularly with a narrow V angle $\alpha$, since the barrels of the cylinders can be pushed together very closely by the offset and staggered without an excessive height of the cylinders above the crankshaft being produced. A very compact motor configuration is thus achieved in which the cylinder spacings in the direction of the crankshaft are minimized without any significant increase in the structural dimensions in the direction of the line 1.5 being produced. With respect to an inline motor with the same number of cylinders and the same swept volume, a shortening of the crankcase of ca. 20-35% can be achieved. The degree of shortening has the following most important influencing parameters:

Height of the cylinder above the crankshaft

V angle

Degree of offset

Crankshaft strength (bearing breadth)

Dimensioning of the gas exchange passages in the cylinder head

A further contribution to compactness is that, with a given crank circle 1.1 with radius h and a given bore with radius r and with a connecting rod 1.4 of length l, the stroke increases slightly by the amount b as a result of the offset and the following swept volume $V_s$ per cylinder results from FIG. 1 in accordance with Pythagoras $$V_s=\{\sqrt{(l+h)^2-b^2})-\sqrt{(l-h)^2-b^2)}\}*\pi*r^2$$

The swept volume Vn of the cylinder of a non-offset crank mechanism with a bore radius r and crank circle radius h results on the other hand as a result of the fact that b=0 in:

$$V_n=\pi*r^2*2h\ (<V_s)$$

The swept volume thus increases by the volume $V_s-V_n$

An offset b also results in an asymmetrical angular difference between TDC and BDC with a deviation from symmetrical 180° by the angle $\phi_2-\phi_1$ (FIG. 1). This must be taken account of on the one hand in the force and moment balance for given cylinder configuration and on the other hand also for the design of the valve control times.

Critical for the piston travel with an offset crank mechanism are the connecting rod ratio λ=h/l and the ratio of the degree of offset to the connecting rod length: β=b/l.

Any desired piston position $x_k$ thus results as a function of the crank angle ϕ in accordance with the equation:

$$x_k=h*\{(\lambda^{-1}*\sqrt{(1+\lambda^2)^2-\beta^2})-(\cos\phi+\lambda^{-1}*\sqrt{1-(\lambda*\sin\phi\pm\beta)^2})\}$$

In this equation, the sign for β is to be selected in accordance with FIG. 1. If the offset b and thus β is set to 0 in the equation, the known equation for a simple crank mechanism is produced.

When selecting a narrow V angle α, with a given degree of offset b, a considerable length reduction d (FIG. 1) is obtained by the upward displacement of the crankshaft from point 1.2 to point 1.1 and on the other hand this opens up the possibility of positioning a commonly used cylinder head flat on the joint line 1.5 for both cylinders, whereby the cylinders are each inclined outwardly by α/2 with respect to the perpendicular to the joint line. This permits both banks of cylinders to be controlled by a common cylinder head instead of using two separate cylinder heads, which proves to be advantageous for the structural dimensions and weight of a motor cycle motor. The maximum sensible V angle α which permits the use of a common cylinder head, is limited by the increase in the lateral piston forces, by the combustion pressure and by the valve geometry.

Traditional V motors use a common crankpin for mutually opposing pairs of pistons. For quiet motor running, this necessitates V angles which, with the given number of cylinders, enable a uniform ignition distribution over a 4-stroke cycle of 720° crank angle. Thus, for instance, a traditional V8 motor has a strictly defined V angle of α=90° for uniform ignition distribution, which results from the division of a 4-stroke cycle of 720° by the number of cylinders (720°/8=90°. With a narrow cylinder angle, as described above, and conventional numbers of cylinders and common crankpins in pairs, this is unfavourable because a traditional V motor would require, for instance, 48 cylinders with a V angle of 15° (48×15°=720°) in order to achieve uniform ignition distribution. In order to render this possible even with a small number of cylinders, the crankshaft of V-inline motors has a crankpin for each cylinder. The reduced breadth of the main bearings, connecting rod bearings and crank cheeks as a result of the close cylinder arrangement can be compensated for by a larger bearing diameter and covers. As a result of the V angle and the asymmetry of the crank distances and angles, the crankpins must be arranged with different angular differences as in an inline motor. Thus, for instance, in a V-inline motor, the angular offset present in an R6 inline motor of the crankpins of 120° (6×120°=720°) must be so corrected that a uniform ignition distribution of 120° is maintained. For this purpose, each crankpin is rotated through one half of the V angle α/2 and through the TDC angle $\phi_1$ (FIG. 1) in the direction of the respective cylinder central axis.

Cylinder heads for V-inline motors are characterised by inlet and outlet passages of different lengths which results in electronic motor control systems having to take account of parameters such as ignition angle and injection times, amongst others, on an individual cylinder basis. Inlet duct systems and exhaust systems must also be matched to these conditions. A V-inline motor with an odd number of cylinders (e.g. 3, 5, 7) does of course have a short and a long row of cylinders. This is geometrical property may be made use of for a motor cycle motor whose outer shape has a considerable influence on the aerodynamics of a motor cycle. The V-inline cylinder arrangement of a V-inline motor can thus be of forwardly tapering shape (FIG. 2). The cylinder head is arranged with the camshaft central axis above the rear row of cylinders 2.2 and the camshaft central axis above the front row of cylinders 2.1 above the crankshaft central axis 2.3. The gas passages may advantageously be so arranged that the cylinders and cylinder head are of narrower construction in the forward direction and a transverse mounting, which is particularly favourable from the point of view of flow, of the motor into a motor cycle is thus possible. The different geometrical characteristics of the inlet and outlet passages above the two rows of cylinders are taken account of by a matched arrangement of the inlet duct system and exhaust system and by the electronic motor control systems referred to above.

The advantageous tapering of V-inline motor cycle motor with an odd number of cylinders in the direction of movement also means that a camshaft construction matched to it is selected (FIG. 3) Two camshafts with central axis 3.2 and 3.3 are disposed above the crankshaft with central axis 3.1. The rear camshaft 3.4 for the longer bank of cylinders is driven directly by the crankshaft via a chain 3.6 whilst the front camshaft 3.5 is driven by the rear camshaft 3.4 by means of a second chain or by gearing 3.9 in another plane within the tapered portion extending perpendicular to the camshaft axis. The length of the front camshaft 3.5 can thus be matched to the streamlined tapered shape of the cylinder head. When using two camshafts for four rows of valves, diagonal rocker arms 3.8 are used, which actuate the valve shafts 3.7 of the four rows of valves. The primary drive to the transmission is situated on the side of the crankshaft 3.10 opposite to the camshaft drive.

Figure 4:
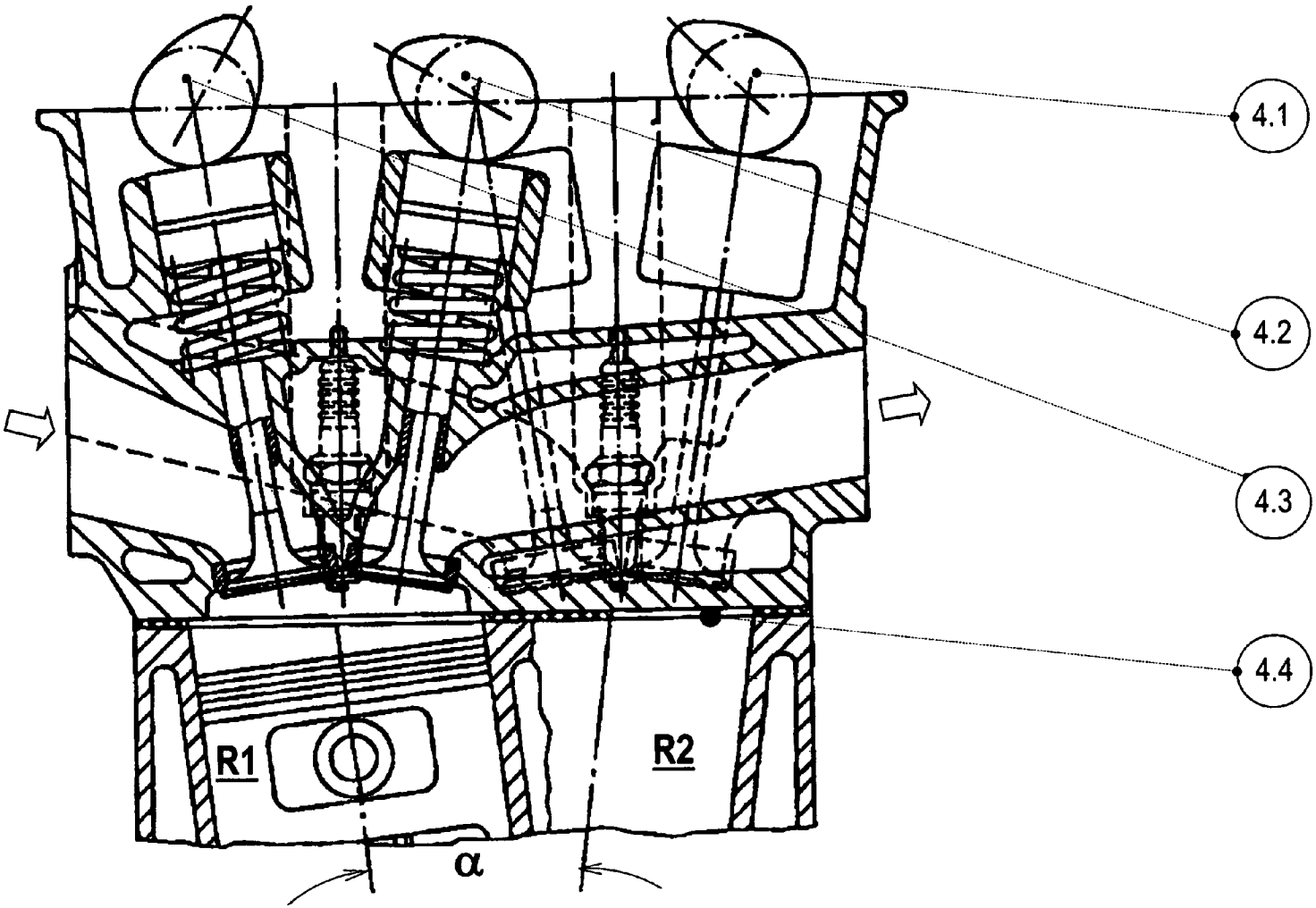

For V-inline motor cycle motors with an even number of cylinders or when omitting the tapered shape referred to above in V-inline motor cycle motors with any desired number of cylinders, a very stiff, fixed speed transverse current valve actuation with cup tappets may be implemented, which advantageously makes use of the geometrical advantages of a common cylinder head for the two rows of V-inline cylinders in a space- and weight-saving manner (FIG. 4). A common cylinder head is positioned at the parting line 4.4 on a V-inline cylinder block with a V angle a and rows of cylinders R1 and R2. The row of V-inline cylinders R1 has short inlet passages, which are controlled by means of the camshaft 4.3 and its valves. In an analogous manner, the row of V-inline cylinders R2 has a short outlet passages which are acted on by the camshaft 4.1 and its valves. The two rows of valves for the long outlet passages of R1 and for the long inlet passages of R2 are actuated by means of the camshaft 4.2. These two rows of valves are so arranged that their central axes intersect the central axis of the camshaft 4.2 and can both use it. A stiff, fixed speed and space-saving cup tappet arrangement is thus produced with only three camshafts. This arrangement is also usable for cylinder heads with more than two valves per cylinder and is suitable, in particular, for use in high speed motor cycle motors.

Figure 5:
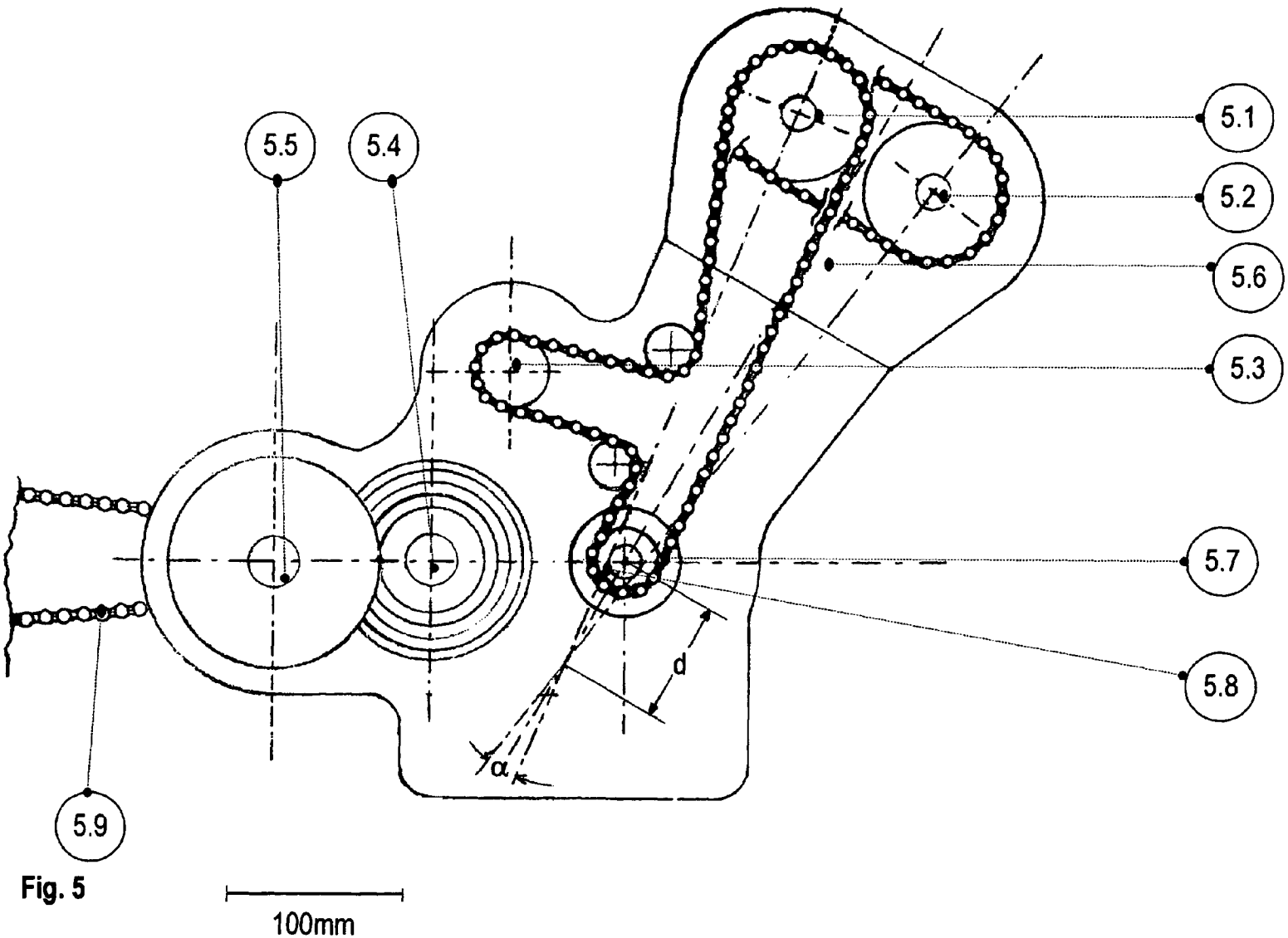

A transversely installable V-inline motor cycle motor is shown diagrammatically in side view as an example of a V-inline motor cycle motor (FIG. 5/6). The capacity of 1005 cm is produced from six cylinders with a 57.6 mm bore, 64.4 mm stroke and an offset distance b of +/−8.9 mm and a cylinder spacing of 46.2 mm in the direction of the crankshaft, three cylinders being arranged in each V-inline row. The V angle $\alpha$ in this exemplary embodiment is 15°. The motor breadth which may be achieved thereby is in the region of comparable current four cylinder motor cycle motors with a similar capacity.

The principle of the monobloc motor cycle motor, which is space-saving and generally known in motor cycle manufacture, is combined in this case with the advantages of the V-inline principle. A monobloc motor in motor cycle technology is characterised in that the motor and gear box constitute a space- and weight-saving unit by using a common housing and a common oil reservoir. The crankshaft and gear box shaft up to the gear box output are arranged parallel to one another. A primary drive from the crankshaft via toothed wheels or a chain to the intermediate shaft, on which the clutch is located, is common. The adjoining main transmission shaft serves at the same time as a driven shaft on a secondary drive (chain or cardan shaft) to the rear wheel.

As a result of the offset crank mechanism (offset circle 5.8, 6.9 with radius +/−b), the length and height of the motor is reduced by the amount d. The V-inline cylinder bank is inclined forwardly by 30° from the vertical in order to achieve favourable installation geometry for motor cycles. With this cylinder inclination, the crank offset results in the spacing d and thus in a saving in length of 34 mm and a vertical saving of 59 mm whilst the breadth of the motor in the direction of the crankshaft significantly decreases by comparison with an inline motor as a result of the two rows of cylinders 6.1, 6.2, which have been moved together and are offset with the connecting rods 6.7, with the cylinder spacing of 46.2 mm (with a bore of 57.6 mm) without gaining significantly in length in the direction of movement. The drive 5.7 for the two camshafts 5.1 and 5.2 is situated laterally in a plane without tapering in the forward direction. The camshaft chain additionally drives an auxiliary shaft 5.3, which serves to drive auxiliary units such as a starter generator and pumps. The ends of the crankshaft thus remain free of units which would result in a greater breadth and accommodate only the primary drive 6.10 and the camshaft chain drive 5.7.

The cylinder head 5.6 or 6.6, which is used jointly by both V-inline rows, is constructed in this exemplary embodiment with an OHC valve drive with two camshafts and rocking levers in order to render possible the actuation of four rows of valves with two camshafts.

The forque is conducted via the transmission main shaft 5.5 or 6.5 to the chain pinion 6.11 for the rear wheel drive chain 5.9 or 6.12 via the primary drive 6.10 and intermediate shaft 5.4, on which the oil bath plate clutch 6.4 is arranged. Assemblies, which are not shown, such as mixture forming apparatus and exhaust gas ducting are similar as regards their physical construction to those of traditional inline motors with the limitation that the inlet and outlet passages within the cylinder head differ in their length between the banks of cylinders.

Motor cycle constructions with a V-inline motor and a longitudinally mounted crankshaft are distinguished by vertically extending, non-inclined cylinders (horizontal longitudinal shaft chain with a cardan drive to the rear axle) and a blocked, separate gearbox instead of a monobloc motor housing. The breadth, length and height dimensions, which are favourable for motor cycles, leave a lot of clearance for the selection of the number of cylinders and the swept volume.

A longitudinally mountable W8 motor cycle motor with inlet duct injection is shown diagrammatically in front view in FIG. 7 as an exemplary embodiment of a W motor construction for a motor cycle. The capacity of 1500 cm is produced by 8 cylinders with a 60.6 mm bore, 65 mm stroke and the two offset dimensions b of +/9 mm in each case and a cylinder spacing in each bank of 46.9 mm in the direction of the crankshaft. Two cylinders are arranged in each of the four rows of cylinders. The V angle $\alpha$ within the two rows of V-inline cylinders in this exemplary embodiment is 15°. By joining together the two V-inline cylinder banks at an angle $\beta$ of 72°, a composite motor block is produced with an external angle of 87° and an external breadth of 500 mm. This is a favourable breadth for motor cycle motors, particularly due to the upwardly open V shape, with which a large banking angle is achieved when driving round a bend. In order to make as compact as possible a structural length possible, each two cylinders are associated with a respective crank pin in the W motor cycle motor. Each two opposed pairs of pistons of the cylinder row 7.10 and 7.5 and the cylinder row 7.6 and 7.7 act on a common crank pin at a respective internal angle of 72° so that a crank star is produced with four cranks. The ignition distribution which is thus produced would be uniform in accordance with the quotient of 720°/10 for a ten cylinder. With an eight cylinder, however, a necessary V angle of 90° is produced in accordance with the quotient of 720°/8. The result of this for this eight cylinder W motor within the cylinder pairs, which use common crank pins is a deviation of 90°−72°=18° from the uniform ignition distribution, which prevails in an analogous ten cylinder engine. This deviation can be achieved in accordance with FIG. 7 by an offset of the two associated connecting rods within a crank pin by the angle .epsilon.=18° ("split-pin"). For this purpose, the two circular cross sections 7.8 of the two crank pin bearings within a crank pin are displaced with respect to one another by 18° on the crank circle. With a sufficient bearing diameter, the overlap is large enough in order to ensure adequate strength.

In this manner, as a result of skilful combination of the V-inline angle .alpha., bank angle $\beta$ and split-pin angle $\epsilon$, different cylinder numbers and constructions can be realised with uniform ignition distribution and for individual dimensions. Eight ten and twelve cylinder arrangements, in particular, are advantageous, in which a uniform ignition distribution can be achieved by the selection of a suitable connecting rod offset angle $\epsilon$. In a twelve cylinder with $\alpha$=15° and $\beta$=72°, this can be achieved, for instance, (analogously to the calculation for an eight cylinder) by a connecting rod offset angle $\epsilon$=−12° (60°−72°=−12°). Furthermore, W motor arrangements for motor cycles are possible, in which the maintenance of a uniform ignition distribution system over a 720° angular crank cycle is omitted since the goal of maximum quietness when moving is not always in the foreground with motor cycles. Constructions with this characteristic are known in the motor cycle industry, for instance with traditional V2 motors. In addition to a particularly short crankshaft, it proves to be advantageous for the exemplary embodiment of FIG. 7 that as a result of the common usage of the crank pins by two cylinders in each case, a smaller offset between the two V-inline banks is possible, which corresponds to the thickness of the lower connecting rod eyes (exemplary embodiment FIG. 7: 10 mm).

FIG. 7 also shows an OHC valve actuation, in which the respective outer camshaft 7.12 of each V-inline bank controls both outlet valves by means of drag rockers whilst the respective inner camshaft 7.13 of each V-inline bank actuates both inlet valves. Inlet and outlet valves of different length are necessary as a result of the geometry thus produced. A change in the control time is possible in this construction by rotating the camshafts since each camshaft actuates only inlet or outlet valves. The different geometry of the inlet and outlet passages necessitates two different positions of the injection nozzles. Whilst the injection nozzle 7.2 supplies the long inlet passage of the left hand, first row of cylinders 7.10, the injection nozzle 7.1 shows the positioning for a short inlet passage. The differences in length of the outlet passages are the reverse of those of the associated inlet passages. In addition to the cylinder—specific matching mentioned above by an electronic motor controller for the different shapes of the inlet and exhaust gas conduits, optimal matching can be achieved additionally by matched opening times of the valves, depending on the breathing geometry.

The two rows of cylinders in each of the two V-inline cylinder banks are offset by the offset dimension b, which is +/−9 mm and corresponds to the radius of the circle 7.9. The motor thus gains compactness because the two V-inline cylinder banks are pushed into one another by the offset. With a V-inline angle $\alpha$ of 15° and a bank angle $\beta$ of 72° there is a height reduction $d_v$ of 55.8 mm and a breadth reduction of $2*d_h$=81 mm.

Further advantageous embodiments of a W motor cycle motor are produced by mounting with a transversely extending crankshaft and the use which thereby becomes possible of a monobloc motor housing (common housing for motor and gearbox). The favourable breadth, length and height dimensions allow a great deal of free space in this case also for the selection of the number of cylinders and swept volume which may be harmoniously introduced into the lines of a motor cycle.

Figure 8:
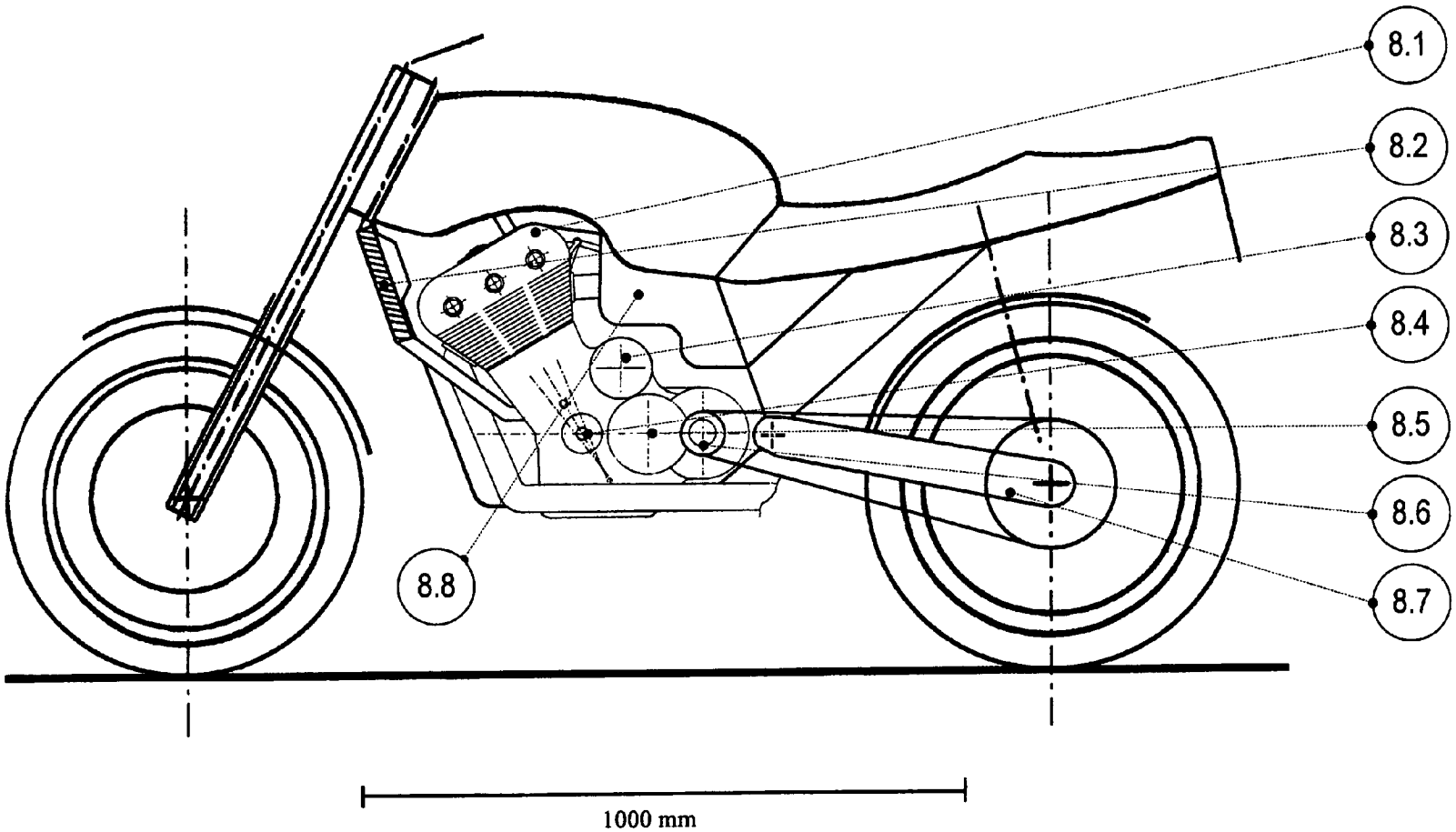

The advantageous properties of V-inline motors for motor cycles result from the suitability of a large volume multi-cylinder V-inline motor for a small vehicle, as shown in FIGS. 8 and 9. With a relatively small wheel spacing of 1440 mm, a V-inline monobloc motor may be installed with a harmonious contour with six cylinders and 1005 cm at a V-inline angle .alpha. of 15°, 57.6 mm bore, 64.4 mm stroke, and offset dimension of +/−8.9 mm and a cylinder spacing of 46.2 mm. Despite the small wheel spacing, a long distance of 575 mm can be achieved between the output opinion and rear axle, whereby a long rear wheel beam 8.7 which is favourable as regards driving dynamics, is made possible. Furthermore, a fixed speed cylinder head 8.1 can be implemented with three camshafts and cup tappets. The water cooler 8.2 is necessary in order to ensure adequate cooling for the rear V-inline cylinder row with three cylinders directed away from the wind. Despite the short wheel spacing, this arrangement permits a telescopic fork spring travel of more than 120 mm to be maintained with a conventional front fork angle, track alignment and wheel diameter. In order to minimize the breadth of the motor, auxiliary units 8.3, such as starter, light machine and pumps are arranged in a space saving manner separately and above the crankshaft 8.4, the intermediate shaft with clutch 8.5 and the driven shaft 8.6. The two crankshaft ends are thus acted on only by the camshaft drive and primary drive and the motor thus has a favourable breadth at the crankshaft height of 371 mm (FIG. 9). Conventional transversely mounted inline motor cycle motors with only four cylinders in this capacity class have a breadth of ca. 400 mm.

Elements such as the air filter, ignition device, inlet duct injector and the inlet duct with an air volume meter, throttle flap and air filter, are arranged in the volume 8.8 or beneath the seat and connected to the cylinder head 8.1.

The advantageous characteristics of W motors for motor cycles may be shown by the suitability of a large volume motor in a motor cycle of average size (FIGS. 10, 11). The swept volume of 1500 cm is produced from eight cylinders with a 60.6 mm bore, 65 mm stroke, the two offset dimensions b of +/−9 mm in the two V-inline banks and a cylinder spacing within each V-inline bank of 46.9 mm. The V-inline angle $\alpha$ within the rows of cylinders of the two cylinder banks in the exemplary embodiment is 15°. The central axes of the two V-inline cylinder banks define an angle $\beta$ of 72°. The maximum external breadth of 500 mm in FIG. 11 is produced at the camshaft drive housing 10.1, which is arranged at the rear of the motor and in which there is a three stage drive. This extends firstly via a main chain from the crankshaft 10.2 to an intermediate shaft 10.3 and from there via two auxiliary chains to the two pairs of crankshafts 10.4 and 11.2 respectively, of the two V-inline banks. The driveline is orientated on known concepts for motor cycle cardan drives with a longitudinal crankshaft with a flywheel connected to it with a dry clutch 10.5 and a flange connected changeover gear 10.6 within its own oil reservoir. In this construction, the short structural length of the motor of only 320 mm (including the clutch on the rear and oil pump drive at the front end of the crankshaft) to the input to the gearbox and a maximum height of 450 mm between the oil pump and the upper edge of the inlet duct proves to be particularly convenient. With a relatively short wheel spacing of 1520 mm the compact dimensions of this W8 arrangement enable a swing length of 447 mm starting from the link bracket/cardan joint 10.7 to the rear axle with b level gearing 10.8. As a result of the advantageous structural length of the motor, the water cooling 10.9 can be so arranged that a spring travel of greater than 150 mm is produced for the telescopic front fork. The high position of the cylinder heads with two camshafts each (with drag rocker arms for 4 rows of valves; 10.4 and 11.2) and the positioning of the exhaust manifold 10.10 and 11.1 in this exemplary embodiment enable large inclined positions when driving round bends.

Auxiliary units 10.11, such as the light machine and starter, are arranged on the periphery of the flywheel 10.5 and are connected to the motor via the toothed rim on the flywheel.

Elements such as the air filter, ignition assembly, inlet duct injection and the inlet manifold with an air volume meter, throttle flap and air filter are arranged in the V gap 10.12 between the two V-inline cylinder banks and behind it above the gearbox 10.6.

The invention claimed is:

1. A motor cycle with an internal combustion engine and a gearbox, the internal combustion engine comprising:

at least two cylinder banks and a common crankshaft, wherein each of the cylinder banks comprise at least three cylinders, wherein the cylinders of each said cylinder bank are arranged in two cylinder rows which are pushed into one another and are offset, wherein two planes, which are defined by a cylinder axis of each cylinder row, constitute an acute V angle and intersect beneath a crankshaft axis, so that an offset crank mechanism is formed, wherein each cylinder of each said cylinder bank is assigned to a separate crank pin of the common crankshaft, wherein the cylinders of the two cylinder rows of each said cylinder bank comprise a common cylinder head, wherein each said cylinder bank, the crankshaft, and the gearbox are configured to fit within a common housing which includes a common oil reservoir, wherein the common cylinder head comprises a transverse current valve actuation with cup tappets, wherein the valves of four rows of valves of two cylinder rows are actuated by operation of three camshafts, and wherein the central axes of two rows of valves intersect the central axis of one camshaft.

2. A motor cycle according to claim 1, wherein the crankshaft is arranged transversely to the direction of motion of the motor cycle.

3. A motor cycle according to claim 1, wherein the crankshaft is arranged longitudinally with respect to the direction of motion of the motor cycle.

4. A motor cycle according to one of the claims 1-3, wherein each of the cylinder banks comprises three to eight cylinders.

5. A motor cycle according to claim 1, wherein two of the cylinder banks acting on the common crankshaft are provided in a W-arrangement.

6. A motor cycle according to claim 5, wherein each of the cylinder banks comprise the same number of cylinders, wherein a cylinder of a first cylinder bank and a respective cylinder of a second cylinder bank, opposed to the cylinder of the first cylinder bank, are assigned to a common crank pin of the common crankshaft.

7. A motor cycle as claimed in claim 1 wherein the engine is a 6 cylinder motor.

8. A motor cycle as claimed claim 1 wherein the engine is a 7 cylinder motor.

9. A motor cycle as claimed claim 1 wherein the engine is a 8 cylinder motor.

10. A motor cycle as claimed in claim 1 wherein there is a W arrangement of the cylinders, which act on the common crankshaft.

11. A motor cycle as claimed in claim 1 wherein the ratio of the cylinder bore diameter to the piston stroke is larger than one.

12. A motor cycle as claimed in claim 1 wherein the ratio of the cylinder bore diameter to the piston stroke is smaller than or equal to one.

* * * * *